United States Patent [19]

Gaglioti

[11] 3,973,856

[45] Aug. 10, 1976

[54] MANHOLE CLOSURE ASSEMBLY

[76] Inventor: Joseph Gaglioti, 1602 Conchester Road, Boothwyn, Pa. 19061

[22] Filed: June 17, 1975

[21] Appl. No.: 587,592

[52] U.S. Cl. ..... 404/25; 210/163
[51] Int. Cl.[2] ..... E02D 29/14
[58] Field of Search ..... 404/25, 26; 210/163

[56] References Cited

UNITED STATES PATENTS

| | | | |
|---|---|---|---|
| 17,613 | 6/1857 | Wolvin | 404/25 |
| 724,635 | 4/1903 | Weller | 404/25 X |
| 1,384,712 | 7/1921 | Shanley | 404/25 |
| 1,738,893 | 12/1929 | Grady | 404/25 X |
| 3,712,009 | 1/1973 | Campagna | 404/25 X |
| 3,891,337 | 6/1975 | McCoy | 404/26 |

*Primary Examiner*—Nile C. Byers, Jr.
*Attorney, Agent, or Firm*—Anthony J. McNulty

[57] ABSTRACT

A manhole closure assembly primarily for preventing drainage and storm water from emptying into a manhole leading to a sewage system. The closure assembly includes a retaining ring secured within a manhole opening, and a removable closure plate seated within an internal opening through the retaining ring for sealing off the manhole opening. A valve assembly for relieving pressure inside a manhole includes a handle connected to the cover plate and spaced above its upper surface, a passageway extending through the cover plate in underlying relationship with the handle, a movable valve element extending through the passageway and having an enlarged, upper sealing member for seating against the upper surface of the cover plate to close the passageway and biasing means positioned between the handle and the enlarged upper sealing member of the movable valve element for normally biasing the sealing member in a downward direction to seal the valve passageway. A plurality of locking assemblies are included for locking the cover plate to the retaining ring.

18 Claims, 6 Drawing Figures

MANHOLE CLOSURE ASSEMBLY

BACKGROUND OF THE INVENTION

1. Field of the Invention

This invention relates to a manhole closure assembly, and more specifically, to a manhole closure assembly including a unique valve assembly for relieving pressure inside a manhole, and a unique locking assembly for locking a removable cover plate of the manhole assembly in sealing relationship with a manhole opening.

2. Description of the Prior Art

It is highly desirable to employ manhole closure assemblies for sealing a manhole opening associated with a sewage treatment plant to segregate drainage and storm water from the plant. Otherwise, the sewage treatment facility would be subjected to the unnecessary burden of having to cope with the excess fluids provided by drainage and storm water. Representative prior art manhole assemblies are disclosed in U.S. Pat. No. 3,621,623, issued to Downes and U.S. Pat. Nos. 3,712,009 and 3,798,848, both of which are issued to Campagna.

Prior art manhole closure assemblies have included a pressure relief valve for relieving pressure inside of a manhole when the pressure therein exceeds a predetermined amount, as exemplified in the above-referred-to Campagna patents. The valve assemblies employed in the Campagna manhole closure assemblies are self-contained units which are installed within a removable cover plate. Specifically, the valve assemblies employ a separate body member which is fastened to the cover plate and a movable valve element extending through a valve opening in the body member. The valve element is normally biased to seal the valve opening, and is actuatable by the build-up of internal pressure within the manhole to unseal said opening.

Manhole closure assemblies with completely self-contained valve members of the type discloses in the Campagna patents are somewhat difficult to construct. Specifically, the closure plate of the assembly must be modified to receive the valve body through it, and care must be taken to rigidly secure the valve body to said cover plate.

The prior art manhole closure assemblies have not included reliable locking means for locking a removable cover plate in sealing relationship with a manhole opening in a substantially tamper-proof manner to minimize the possibility of a child removing the cover plate at an unattended site, and possibly becoming injured, or even killed, by falling into the manhole.

SUMMARY OF THE INVENTION

The manhole closure assembly of this invention includes a retaining ring adapted to be secured within a manhole opening, and a removable closure plate for sealing off an opening extending through the retaining ring. One unique feature of the present invention resides in the inclusion of a pressure relief valve assembly which employs, as part of its construction, a handle which is connected to the cover plate and is spaced above its upper surface. The cover plate constitutes the valve body of the pressure relief valve assembly, and includes an opening, or passageway extending through it in underlying relationship with the handle. A movable valve element extends through the passageway in the cover plate and has an enlarged upper sealing member that is normally biased in a downward direction to seal off the passageway until the internal pressure within a manhole exceeds a predetermined level. The above construction provides a handle which is easily grippable to permit removal of the cover plate from its sealing relationship with the retaining ring, and in addition, doubles as a component of the pressure relief valve assembly. This construction is extremely simple and reliable in operation, and does not require the inclusion of a completely self-contained valve member of the type disclosed in the Campagna patents.

A further unique feature of this invention resides in the inclusion of a plurality of locking assemblies for positively locking the cover plate to the retaining ring to minimize the possibility of a child removing the cover plate from the manhole, and thereafter falling into the manhole to become either injured or killed.

Each locking assembly includes a rotatable, threaded actuating member extending through an opening in the cover plate adjacent a side margin thereof, and a laterally extending locking lug retained on a lower threaded section of the actuating member. A biasing means, preferably in the form of a coil spring, is disposed between the lower surface of the cover plate and the upper surface of the locking lug to normally bias the locking lug in a downward direction. Rotation of the actuating member in one direction will cause the locking lug to move with it from a first position completely underlying the cover plate, to a second position in which a section of the locking lug underlies the retaining ring. A stop member is provided for preventing continued rotation of the locking lug when it is in its second position during continued rotation of the actuating member in said one direction. Accordingly, the continued rotation of the actuating member in said one direction will cause the locking lug to move linearly, in an upward direction, to frictionally seal against the lower surface of the retaining ring and thereby positively lock the cover plate to said retaining ring. Release of the locking lug from the retaining ring is accomplished by reversing the direction of rotation of the actuating member. Specifically, as the actuating member is initially rotated in a reverse direction, the locking lug will move linearly out of frictional engagement with the lower surface of the retaining ring, and thereafter, will move as a unit with the actuating member to its first position completely underlying the upper plate. Preferably, a second stop member is provided for preventing further rotation of the locking lug after it is completely disposed beneath the cover plate.

Most preferably the threaded actuating member is an allen-head bolt, and the head is positioned in a counterbored section of the opening through which the bolt extends so that the upper surface of the head is disposed in substantially the same plane as the upper surface of the cover plate. In this construction the only means of actuating the locking assembly is to employ an allen wrench. Since most children do not have easy access to an allen wrench, the locking assemblies employed in this invention will minimize the possibility of a child removing the cover plate, and thereafter falling into the manhole.

Other objects and advantages of this invention will become apparent upon reading the detailed description which follows, taken in conjunction with the drawings.

DESCRIPTION OF THE PREFERRED EMBODIMENTS OF THIS INVENTION

Figure 1:
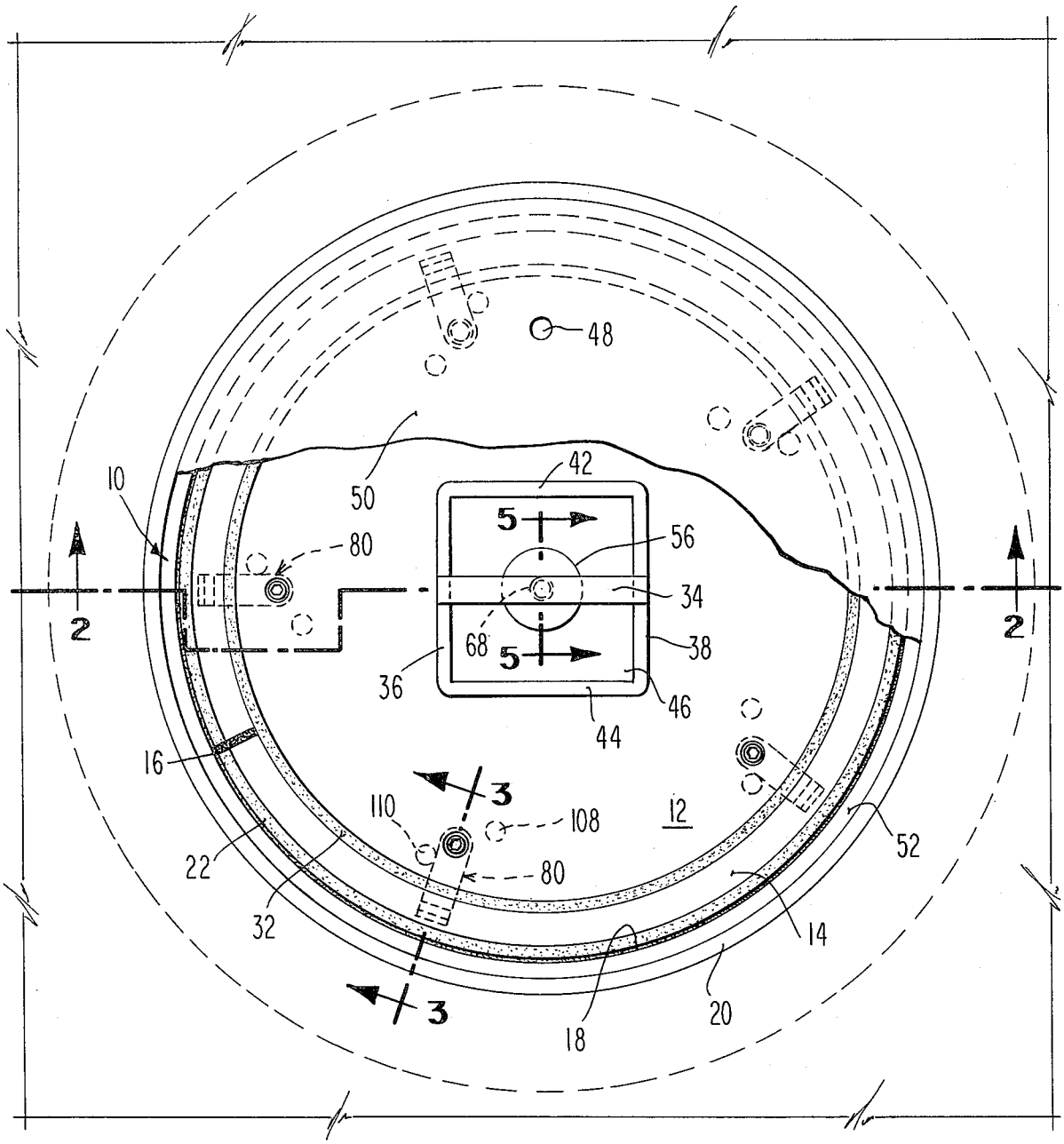
FIG. 1 is a plan view of a closed manhole, with a portion of a manhole cover removed to show details of the manhole closure assembly of this invention.
Figure 2:
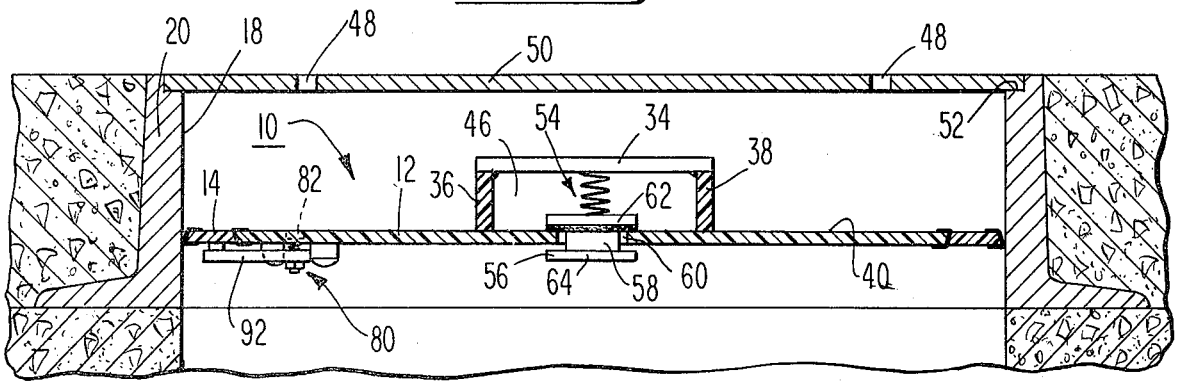
FIG. 2 is a sectional view taken along line 2—2 of FIG. 1.
Figure 3:
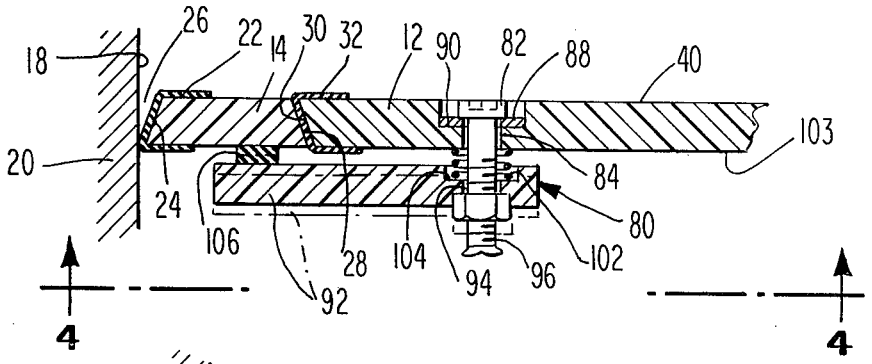
FIG. 3 is a sectional view taken along line 3—3 of FIG. 1.

Referring to FIGS. 1–3, a manhole closure assembly 10 of this invention includes a removable cover plate 12 seated within an opening in a retaining ring 14. The retaining ring 14 is split at 16 (FIG. 1) to permit contraction of the ring as it is force fit against inner surface 18 of a manhole frame 20.

Referring to FIG. 3, a U-shaped gasket 22, which can be made of any suitable resilient material, such as rubber, is positioned about the outer periphery of the retaining ring 14 for aiding in establishing a tight friction fit between said retaining ring and the inner surface of the manhole frame. The retaining ring 14 includes a tapered outer periphery 24, and the gasket 22 positioned about the periphery 24 forms a substantially V-shaped groove 26 with the inner surface 18 of the manhole frame 20. Mortar, cement, or other sealing material (not shown) can be placed into the groove 26 to firmly and permanently attach the retaining ring to the manhole frame.

Referring specifically to FIGS. 2 and 3, the retaining ring 14 includes a tapered inner periphery 28 which establishes an excellent frictional seal with a tapered outer periphery 30 of the cover plate 12. Preferably, a resilient U-shaped gasket 32 is positioned about the outer periphery 30 to insure that a fluid-tight seal is established between the cover plate 12 and the retaining ring 14.

Referring to FIGS. 1 and 2, a handle 34 is fused, or otherwise secured, to spaced apart vertical walls 36 and 38. These vertical walls are firmly attached, such as by fusing, to upper surface 40 of the cover plate. Accordingly, the handle 34 is spaced from the upper surface of the cover plate to provide an easily grippable section which can be engaged to remove the cover plate from the retaining ring 14.

The vertical walls 36 and 38 cooperate with similar spaced apart vertical walls 42 and 44 to define a peripherally enclosed compartment 46 having an opened upper end in communication with atmospheric pressure through openings 48 in a conventional manhole cover 50. In the illustrated embodiment, the manhole cover 50 seats, in a conventional manner, on a ledge 52 of the manhole frame 20. Preferably, the openings 48 are positioned about the periphery of the manhole cover 50 so as not to overlie the compartment 46. In this manner, debris, such as leaves, sand and the like, which pass through the openings 48 will be impeded from entering the compartment 46 to interfere with the operation of a pressure relief valve 54. If desired, the compartment 46 can be eliminated, and the handle can include downwardly extending legs fused to the cover plate, and a horizontal section spaced from the upper surface 40 of said cover plate.

Figure 5:
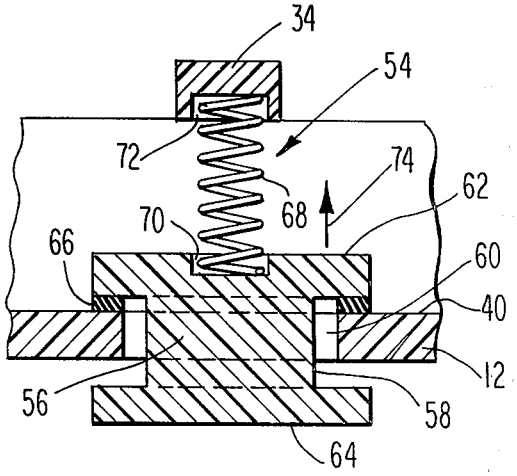
FIG. 5 is an enlarged view taken along line 5—5 of FIG. 1.

Referring to FIGS. 1, 2 and 5, the pressure relief valve 54 employs the removable cover plate 12 as the stationary valve body. A linearly movable valve element 56 includes a central stem portion 58 which extends through a pressure-relief opening 60 in the cover plate 12; the upper surface 40 of said cover plate constituting the valve seat of the pressure-relief valve. The movable valve element 56 includes enlarged, upper and lower sections 62 and 64, respectively, which, in the illustrated embodiment, are in the form of cylindrical disks. Both of the disks 62 and 64 extend beyond the peripheral walls defining the pressure-relief opening 60 to retain the movable valve element 56 within said opening. Preferably, a ring 66 of resilient material is adhered to the underside of the upper disk 62 adjacent the periphery thereof. A biasing means 68, preferably in the form of a coil spring, includes opposed ends which are mounted in recesses 70 and 72 of the upper disk 62 and the underside of the handle 34, respectively. The spring 68 normally biases the movable valve element 56 in a downward direction to seal off the pressure-relief opening 60 from atmospheric pressure. If the pressure within the manhole builds up to a level which exceeds the downward pressure imposed upon the movable valve element 56 by the coiled spring 68, the valve element 56 will be moved upwardly, in the direction of arrow 74, as a result of the action of the internal pressure within the manhole cover on the lower enlarged section 64 of the valve element. Upward movement of the valve element 56 will place the pressure-relief opening 60 in communication with atmospheric pressure to relieve the internal manhole pressure.

From the above description it can be seen that the pressure-relief valve 54 is of an extremely simple construction; employing the handle 34 and the cover plate 12 as part of its construction. Accordingly, this invention does not require the use of a completely self-contained valve which has to be inserted into a cover plate in the manner disclosed in the prior art.

Figure 4:
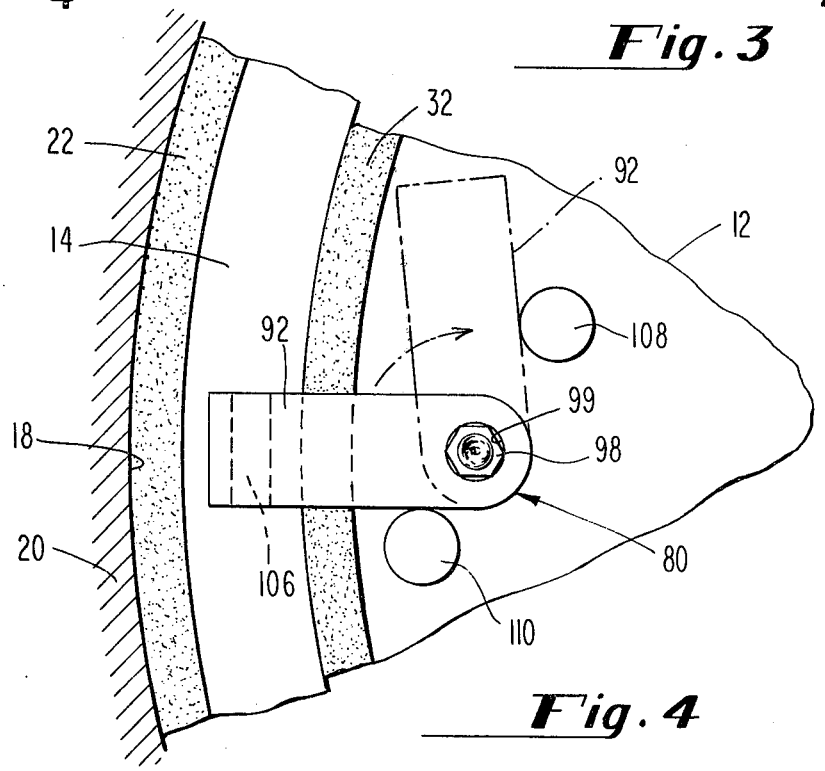
FIG. 4 is a bottom view taken along line 4—4 of FIG. 3.

Referring to FIGS. 1, 3 and 4, the manhole closure assembly 10 includes a plurality of locking assemblies 80 which function to positively lock the removable cover plate 12 to the retaining ring 14. One of the locking assemblies 80 will now be described in detail, it being understood that all of the locking assemblies are of an identical construction. member 82 to retain the locking lug 92 on said actuating member. The nut Referring specifically to FIGS. 3 and 4, each locking assembly 80 includes a threaded actuating member 82, preferably in the form of an allen-head bolt. The actuating member 82 extends through a counterbored opening 84 disposed adjacent the periphery of the cover plate 12. The head 86 of the actuating member seats on a washer 88 which is disposed on a ledge 90 formed by the upper counterbore, and preferably, the upper surface of the head is flush with the upper surface 40 of the cover plate. By mounting the actuating member so that its head is flush with the upper surface of the cover plate, actuation of the locking assembly can only be affected by employing an allen wrench. Since most children do not have easy access to such a wrench, the likelihood of the locking assembly being tampered with by a child is minimized. A laterally extending locking lug 92 includes a counterbored opening 94 through which a lower threaded section 96 of the actuating member 82 extends. A nut 98 is threaded onto the threaded actuated member. The nut 98 preferably is seated within a complementary shaped lower counterbore 99 of the opening 94. The bottom of the actuating member 82 is peened, or otherwise worked, to prevent the inadvertant separation of the actuating member 82 from the nut 98 during operation of the locking assembly.

A biasing means 102, preferably in the form of a coil compression spring, is disposed about the lower threaded section 96 of the actuating member. One end of the coil spring 102 is seated against lower surface 103 of the cover plate, and the other end is seated on a ledge 104 which is provided by an upper counterbore of the opening 94. The spring 102 normally biases the locking lug 92 in a downward direction against the nut 98. Preferably, a resilient sealing strip 106 is adhered to the locking lug 92 at the end which is opposed to the counterbored opening 94. The function of the sealing strip will be described later. The locking assembly 80 further includes stop members 108 and 110 extending downwardly from the lower surface 103 of the cover plate 12 to limit rotational movement of the locking lug 92 between the positions shown in solid lines and phantom lines, respectively, in FIG. 4. The operation of the locking assembly 80 will now be described.

Referring to FIGS. 1 and 4, the removable cover plate 12 is inserted into the opening within retaining ring 14 with the locking lug 92 disposed against stop member 108, as is illustrated in phantom representation in FIG. 4. In this position the entire locking lug is disposed in underlying relationship with the cover plate 12 so as not to interfere with the insertion of the cover plate into the opening through the retaining ring 14. After the cover plate has been inserted into the opening of the retaining ring the allen-head bolt 82 is rotated in a clockwise direction (counter-clockwise direction as viewed from the bottom of the cover plate as shown in FIG. 4). The spring 102 biases the locking lug 92 against the nut 98 to thereby cause the locking lug to rotate as a unit with the actuating member 82. Accordingly, rotation of the actuating member 82 in a clockwise direction will rotate the locking lug into engagement with stop 110. When the locking lug 92 first engages the stop 110 it will be spaced from the lower surface 103 of the cover plate, as is shown in phantom representation in FIG. 3. Continued clockwise rotation of the allen-head bolt 82 will cause the bolt to rotate relative to the nut 98, and thereby move the locking lug in an upward direction to the solid line position shown in FIG. 3. In this latter position the sealing strip 106 will compressively engage the lower surface of the retaining ring 14 to firmly lock the cover plate to the retaining ring. To unlock the cover plate from the retaining ring the operation is reversed. Specifically, the allen-head bolt 82 is rotated in a counter-clockwise direction (clockwise direction as viewed from the underside of the cover plate in FIG. 4) to first lower the locking lug to the position shown in phantom line in FIG. 3, and thereafter to rotate the locking lug into engagement with the stop 108, as is shown in phantom representation in FIG. 4.

From the above discussion, it can be seen that the locking assemblies 80 are operable in a very simple manner to both lock the removable cover plate to the retaining ring 14, and to unlock said cover plate from said retaining ring.

The manhole closure assembly 10 described above is primarily adapted for use in sealing off existing manholes.

Figure 6:
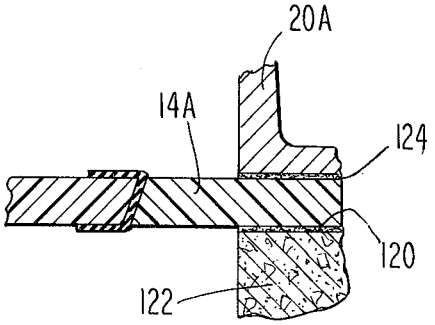
FIG. 6 is a partial sectional view similar to FIG. 2, and showing an alternative arrangement for attaching a retaining ring of the manhole closure assembly to a manhole construction.

Referring to FIG. 6, an arrangement is shown for securing a retaining ring 14A within a manhole as the manhole is being constructed. Specifically, the retaining ring 14A is seated on an upper surface 120 of a cement layer 122 and is sandwiched between said cement layer and a frame member 20A. Mortar, cement, or other sealing material 124 is employed to firmly fix the retaining ring 14A within the manhole. In this construction, the retaining ring preferably is not split in the manner shown in FIG. 1, since a friction fit is not employed to fix the retaining ring within the manhole.

The manhole closure assemblies of this invention can be made of any desired material. Preferably, they are of a lightweight construction; formed from a plastic material, such as Plexiglas.

Having described my invention, I claim:

1. A manhole closure assembly comprising:

A. a retaining ring adapted to be secured within a manhole opening, an inner periphery of said retaining ring defining a central opening therethrough;

B. a removable cover plate having opposed upper and lower surfaces, said cover plate being adapted to seat against the retaining ring for sealing off the opening through said retaining ring;

C. a handle spaced above the upper surface of the cover plate and connected thereto;

D. a pressure-relief passageway extending through the cover plate in alignment with said handle, said passageway providing communication between the upper and lower surfaces of the cover plate;

E. a movable valve element including a central stem extending through said passageway, and an enlarged upper section adapted to engage the cover plate to seal off said passageway when the valve element is biased downwardly; and F. a biasing means retained between the handle and the enlarged upper section of the valve element for normally biasing the enlarged upper section of said valve element in a downward direction to seal off said passageway, said valve element being movable in an upward direction against the force of said biasing means when the pressure within the manhole exceeds a predetermined level.

2. The movable closure assembly according to claim 1, wherein the enlarged upper section extends beyond the entire periphery of said passageway and is adapted to seal off the passageway by engaging the upper surface of the cover plate.

3. The manhole closure assembly according to claim 1, wherein said movable valve element includes an enlarged lower section overlying the lower surface of the cover plate, whereby an excessive pressure build-up within a manhole will act against said lower section to move the valve element in an upward direction to unseal the passageway.

4. The manhole closure assembly according to claim 1, wherein said removable cover plate includes a tapered outer periphery which is adapted to frictionally engage a complimentary, tapered inner periphery of the retaining ring to seal off the central opening through the retaining ring.

5. The manhole closure assembly according to claim 4, including resilient sealing means disposed between the tapered surfaces of the cover plate and retaining ring when the cover plate is positioned to seal off the central opening through the retaining ring.

6. The manhole cover assembly according to claim 5, including resilient sealing means disposed about the outer periphery of the retaining ring, said resilient sealing means being adapted to frictionally engage peripheral walls defining a manhole opening.

7. The manhole closure assembly according to claim 5, wherein the outer periphery of the retaining ring is tapered to provide an upwardly directed notch between the periphery of the manhole and the outer periphery of the retaining ring for receiving a sealing material therein to firmly secure the retaining ring within the manhole opening.

8. The manhole closure assembly according to claim 1, including vertical wall means extending upwardly from the upper surface of the cover plate for providing an upwardly extending compartment which is opened at its upper end and completely surrounds the pressure-relief passageway.

9. The manhole closure assembly according to claim 1, including a plurality of locking assemblies for locking the removable cover plate to the retaining ring, each locking assembly comprising:

A. a rotatable, threaded actuating member extending through an opening in the cover plate adjacent a side margin thereof;

B. a laterally extending locking lug retained on a lower section of the actuating member and rotatable with said actuating member, whereby rotation of the actuating member is one direction will cause the locking lug to move from a first position completely underlying the cover plate to a second position in which a section thereof underlies the retaining ring;

C. a biasing means disposed between a lower surface of the cover plate and an upper surface of the locking lug to normally bias said locking lug in a downward direction; and D. a stop means for preventing continued rotation of the locking lug when it is in its second position during continued rotation of the actuating member in said one direction, whereby said continued rotation moves the locking lug in an upward, linear direction relative to the actuating member to frictionally seat against a lower surface of the retaining ring to lock the cover plate to said retaining ring.

10. The manhole closure assembly according to claim 9, including a lug retaining means threaded onto a threaded section of the actuating member beneath the locking lug, whereby the continued rotation of the actuating member in said one direction, after the locking lug is in its second position, will cause the lug retaining means to move upwardly on the threaded lower section of the actuating member to force the locking lug against the lower surface of the retaining ring.

11. The manhole closure assembly according to claim 9, wherein the threaded actuating member is an allen-head bolt; the head of said bolt being set in a counterbore of the opening through which the bolt extends so that the actuatable head of the bolt is disposed in a plane which is no higher than the plane of the upper surface of the cover plate.

12. The manhole closure assembly according to claim 9, including a second stop means for preventing continued rotation of the locking lug when it is in its first position completely underlying the cover plate during continued rotation of the actuating member in a second direction opposite to said one direction.

13. The manhole closure assembly according to claim 12, wherein a lower section of the actuating member below the locking lug is deformed to prevent the locking lug from separating from said actuating member.

14. The manhole closure assembly comprising:

A. a retaining ring adapted to be secured within a manhole opening, an inner periphery of said retaining ring defining a central opening therethrough;

B. a removable cover plate having opposed upper and lower surfaces, said cover plate being adapted to seat against the retaining ring for sealing off the opening through said retaining ring; the improvement comprising C. a plurality of locking assemblies for locking the removable cover plate to the retaining ring, each locking assembly comprising:

a rotatable, threaded actuating member extending through an opening in the cover plate adjacent a side margin thereof;

a laterally extending locking lug retained on a lower section of the actuating member and rotatable with said actuating member, whereby rotation of the actuating member in one direction will cause the locking lug to move from a first position completely underlying the cover plate to a second position in which a section thereof underlies the retaining ring;

a biasing means disposed between a lower surface of the cover plate and an upper surface of the locking lug to normally bias said locking lug in a downward direction; and a stop means for preventing continued rotation of the locking lug when it is in its second position during continued rotation of the actuating member in said one direction, whereby said continued rotation moves the locking lug in an upward, linear direction relative to the actuating member to frictionally seat against a lower surface of the retaining ring to lock the cover plate to said retaining ring.

15. The manhole closure assembly according to claim 14, including a lug retaining means threaded onto a threaded section of the actuating member beneath the locking lug, whereby the continued rotation of the actuating member in said one direction, after the locking lug is in its second position, will cause the lug retaining means to move upwardly on the threaded lower section of the actuating member to force the locking lug against the lower surface of the retaining ring.

16. The manhole closure assembly according to claim 14, wherein the threaded actuating member is an allen-head bolt; the head of said bolt being set in a counterbore of the opening through which the bolt extends so that the actuatable head of the bolt is disposed in a plane which is no higher than the plane of the upper surface of the cover plate.

17. The manhole closure assembly according to claim 14, including a second stop means for preventing continued rotation of the locking lug when it is in its first position completely underlying the cover plate during continued rotation of the actuating member in a second direction opposite to said one direction.

18. The manhole closure assembly according to claim 17, wherein a lower section of the actuating member below the locking lug is deformed to prevent the locking lug from separating from said actuating member.

* * * * *